United States Patent [19]

Matsuyama

[11] Patent Number: 4,865,474

[45] Date of Patent: Sep. 12, 1989

[54] CHARACTER IMPUTTING ELECTRONIC EQUIPMENT WHICH SETS INPUT MODE BASED ON TAB POSITION

[75] Inventor: Shigeru Matsuyama, Yokohama, Japan

[73] Assignee: Canon Kabushiki Kaisha, Tokyo, Japan

[21] Appl. No.: 936,739

[22] Filed: Dec. 2, 1986

[30] Foreign Application Priority Data

Dec. 5, 1985 [JP] Japan ..... 60-272512

[51] Int. Cl.[4] ..... B41J 21/00

[52] U.S. Cl. ..... 400/61; 400/76; 400/279

[58] Field of Search ..... 400/16, 17, 21, 22, 400/76, 61, 279, 303; 340/709, 711, 735, 748

[56] References Cited

U.S. PATENT DOCUMENTS

| | | | |
|---|---|---|---|
| 3,911,419 | 10/1975 | Bates et al. | 340/735 |
| 4,086,660 | 4/1978 | McBride | 400/76 |
| 4,205,922 | 6/1980 | Pascoe | 400/76 |
| 4,459,678 | 7/1984 | McCaskill et al. | 400/279 |
| 4,553,866 | 11/1985 | Demonte et al. | 400/279 |
| 4,666,321 | 5/1987 | Kumagai | 400/285 |

*Primary Examiner*—David A. Wiecking

*Attorney, Agent, or Firm*—Fitzpatrick, Cella, Harper & Scinto

[57] ABSTRACT

A character inputting electronic equipment includes a tabulation setting device for setting tabulation, a mode selection device for selecting one of a plurality of character input modes, a memory for storing a tabulation position to be set by the tabulation setting device, and a mode memory for storing a mode designated by the mode selection device for the tabulation stored in the memory by the tabulation setting device.

9 Claims, 4 Drawing Sheets

| PROCEDURE | KEY OPERATION | C P | MODE | HOMO | TAB 1 | | TAB 2 | | TAB3 | | DISPLAY |
|---|---|---|---|---|---|---|---|---|---|---|---|
| | | | | | POSI-TION | MODE | POSI-TION | MODE | POSI-TION | MODE | |
| 1 | POWER ON | 1 | ALPHA | ALPHA | 0 | | 0 | | 0 | | – |
| 2 | [ ] [ ] [ ] | 4 | ALPHA | ALPHA | 0 | | 0 | | 0 | | – |
| 3 | [片] | 4 | KATA | ALPHA | 0 | | 0 | | 0 | | – |
| 4 | [TAB-SET] | 4 | KATA | ALPHA | 4 | KATA | 0 | | 0 | | – |
| 5 | [RETURN] | 1 | ALPHA | ALPHA | 4 | KATA | 0 | | 0 | | – |
| 6 | [V ヒ] | 2 | ALPHA | ALPHA | 4 | KATA | 0 | | 0 | | V – |
| 7 | [8 ユ] | 3 | ALPHA | ALPHA | 4 | KATA | 0 | | 0 | | V 8 – |
| 8 | [TAB] | 4 | KATA | ALPHA | 4 | KATA | 0 | | 0 | | V 8 – |
| 9 | [G キ] | 5 | KATA | ALPHA | 4 | KATA | 0 | | 0 | | V 8 キ– |
| 10 | [7 ヤ] [K ,] [Y ン] | 8 | KATA | ALPHA | 4 | KATA | 0 | | 0 | | V 8 キャン– |
| 11 | [RETURN] | 1 | ALPHA | ALPHA | 4 | KATA | 0 | | 0 | | – |

FIG. 2

| PROCEDURE | KEY OPERATION | C P | MODE | HOMO | TAB 1 | | TAB 2 | | TAB3 | | DISPLAY |
|---|---|---|---|---|---|---|---|---|---|---|---|
| | | | | | POSI-TION | MODE | POSI-TION | MODE | POSI-TION | MODE | |
| 1 | POWER ON | 1 | ALPHA | ALPHA | 0 | | 0 | | 0 | | – |
| 2 | [ ] [ ] [ ] | 4 | ALPHA | ALPHA | 0 | | 0 | | 0 | | – |
| 3 | [片] | 4 | KATA | ALPHA | 0 | | 0 | | 0 | | – |
| 4 | [TAB-SET] | 4 | KATA | ALPHA | 4 | KATA | 0 | | 0 | | – |
| 5 | [RETURN] | 1 | ALPHA | ALPHA | 4 | KATA | 0 | | 0 | | – |
| 6 | [Vヒ] | 2 | ALPHA | ALPHA | 4 | KATA | 0 | | 0 | | V – |
| 7 | [8ユ] | 3 | ALPHA | ALPHA | 4 | KATA | 0 | | 0 | | V8 – |
| 8 | [TAB] | 4 | KATA | ALPHA | 4 | KATA | 0 | | 0 | | V8 – |
| 9 | [Gキ] | 5 | KATA | ALPHA | 4 | KATA | 0 | | 0 | | V8 キー |
| 10 | [7ヤ] [K,] [Yン] | 8 | KATA | ALPHA | 4 | KATA | 0 | | 0 | | V8 ギャンー |
| 11 | [RETURN] | 1 | ALPHA | ALPHA | 4 | KATA | 0 | | 0 | | – |

START
S1
CLEAR RAM
CP ← "1"
HOMO ← 英
S2
(MODE) ← (HOMO)
S3
DISPLAY DATA OF DISP
S4
KEY INPUT ?
YES
NO
S5
CHARACTER KEY ?
YES
NO
S9
MD KEY ?
YES
NO
S10
STORE MODE CODE CORRESPONDING TO ALPHA/HIRA/KATA INTO MODE
S11
CP = 1 ?
YES
NO
S12
(HOMO) ← (MODE)
S13
TAB SET KEY ?
YES
NO
(TAB KEY)
S14
(TABI) POSITION=0 ?
YES
NO
S15
(TABI) POSITION ← (CP)
(TABI) MODEI ← (MODE)
S20
(TABI) POSITION>(CP) ?
YES
NO
S21
(CP) ← (TABI) POSITION
(MODE) ← (TABI) MODEI

CHARACTER IMPUTTING ELECTRONIC EQUIPMENT WHICH SETS INPUT MODE BASED ON TAB POSITION

BACKGROUND OF THE INVENTION

1. Field of the Invention

The present invention relates to electronic equipment such as a computer terminal, electronic typewriter or word processor, having various character input modes, and more particularly to character inputting electronic equipment having a function of automatically setting of a character input mode in accordance with user designation in a tabulation operation.

2. Related Background Art

In conventional electronic equipment of this type, such as an electronic typewriter, when a tabulation key is depressed, a cursor or carriage is moved to a position specified by a user and stops there.

Particular users or a particular application may, however, require that the character inputting be carried out in a different character input mode after a preset tabulation position. In the prior art electronic typewriter, in such a case, the user must set the desired character input mode each time the preset tabulation position is reached. Therefore, key operation is complex.

SUMMARY OF THE INVENTION

In view of the above-noted disadvantage peculiar to the prior art, it is an object of the present invention to provide a character inputting electronic equipment which, when a preset tabulation position is reached, automatically sets a character input mode to one which has been preset at the time of the tabulation setting so that the key input operation is efficiently carried out.

It is another object of the present invention to provide a character inputting electronic equipment capable of storing a character input mode for a preset tabulation position.

It is still another object of the present invention to provide character inputting equipment which can set a mode to one which has been preset for a preset tabulation position.

It is yet still another object of the present invention to provide a character inputting electronic equipment which can set a display mode for input character data at a predetermined position on a display screen.

BRIEF DESCRIPTION OF THE DRAWINGS

FIG. 2 shows a procedure for the keying operation,

DETAILED DESCRIPTION OF THE PREFERRED EMBODIMENTS

Figure 1:
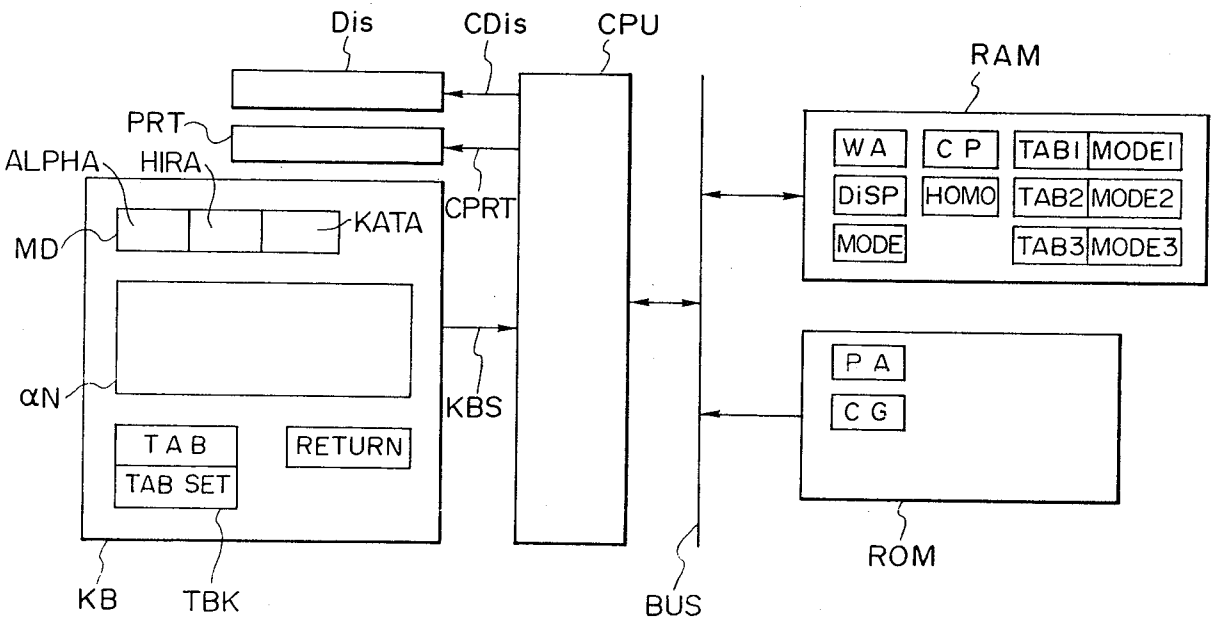
FIG. 1 shows a block diagram of one embodiment of the present invention.

FIG. 1 shows a block diagram of one embodiment of the present invention.

KB denotes a keyboard which comprises alphanumeric keys αN including alphabet keys A–Z, numeric keys 0–9, punctuation keys (space, comma and period), tabulation keys TBK including a tab set key "TABSET" and a Tab-key "TAB", a return key "RETURN", and mode keys MD for designating character input mode 英"ALPHA" for alphanumeric characters, 平"HIRA" for Japanese HIRAGANA characters, or "KATA" for Japanese KATAKANA characters of Japanese character.

CPU denotes a control unit in the form of microprocessor. It may be a sequential control circuit including a clock pulse generator, delay circuits, gate circuits and other logic circuits.

DiS denotes a display device such as a dot matrix type liquid crystal display. It displays characters input from the keyboard KB, under control of a display control signal CDiS from the control unit CPU.

PRT denotes a printer, such as a serial printer, which prints out on a print sheet input characters such as characters and numerals corresponding to a key input signal KBS supplied from the keyboard KB, under control of a print control signal CPRT supplied from the control unit CPU.

Figures 3, 3A, 3B:
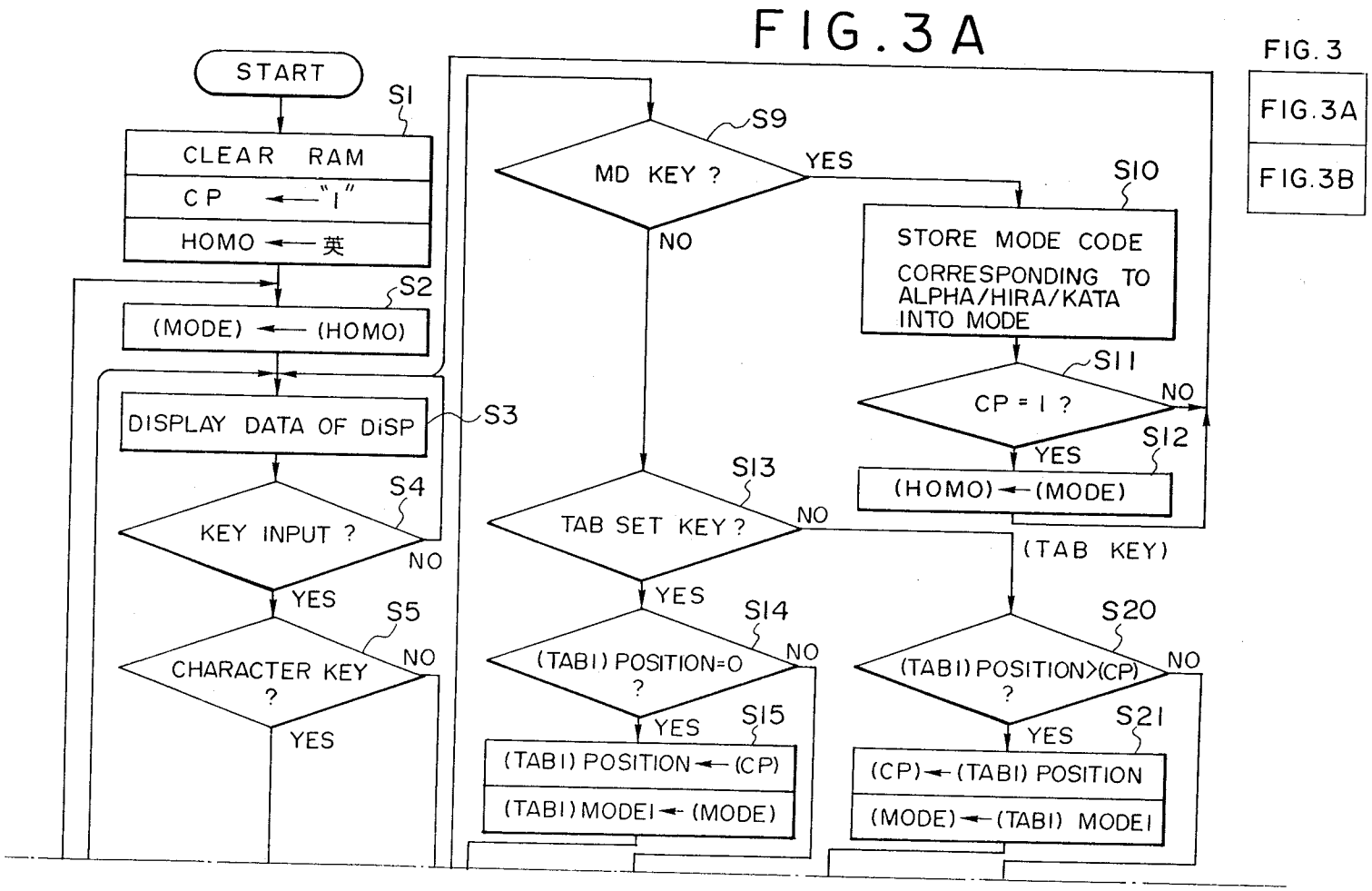
FIG. 3 shows how FIGS. 3A and 3B fit together.
FIGS. 3A and 3B show a flow chart of a series of control operations relating to the keying operation.
Figure 3B:
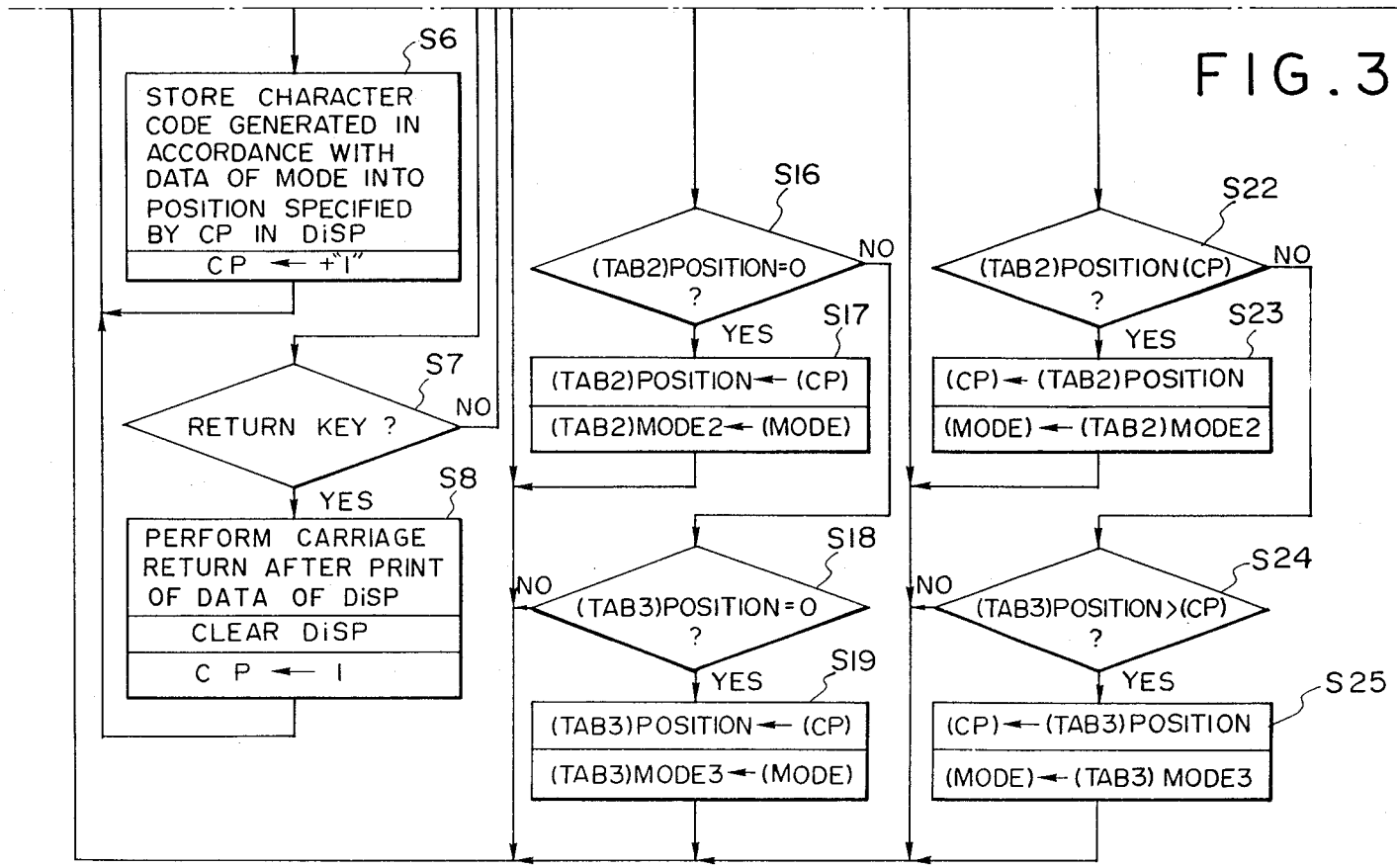

ROM denotes a read-only memory which contains a program area PA having microinstructions necessary to carry out a control procedure shown in FIG. 3 by means of control unit CPU when the control signals are to be sent from the control unit CPU to the printer PRT and the display device DiS, and a character generator CG which contains character patterns for character codes for respective modes.

RAM denotes a writable random access memory which comprises an area WA for storing operation states of the device, a display memory DiSP for storing input character data for displaying, memories TAB1–TAB3 for storing tabulation positions, a cursor pointer CP for storing a cursor position, a mode memory MODE for storing a current character input mode, a home mode memory HOMO for storing a character input mode at a home position, and areas MODE1–MODE3 for storing modes for the memories TAB1–TAB3.

BUS denotes a bus line which electrically connects the control unit CPU, the read-only memory ROM and the random access memory RAM to transfer memory addresses and data.

The operation of the embodiment of electronic equipment according to present invention shown in FIG. 1 is explained with reference to a keying operation procedure shown in FIG. 2 and a flow chart shown in FIGS. 3A and 3B.

In accordance with a keying operation procedure 1 of FIG. 2, a power switch (not shown) on the keyboard KB is depressed to turn the power on. Thus, the control unit CPU clears all memory areas of the random access memory RAM in a step S1 of the flow chart shown in FIG. 3, sets the cursor pointer CP for storing the cursor position on the display DiS to "1", and stores a code "ALPHA" indicating the alphanumeric input mode in the mode memory HOMO for the home position.

In a step S2, the character input mode code "ALPHA" stored in the home mode memory HOMO is read out and stored into the mode memory MODE. In steps S3 and S4, the display data in the display memory DiSP of the random access memory RAM is displayed on the display device DiS and the depression of the key on the keyboard KB is monitored.

In a keying operation procedure 2, when a key input signal KBS from the space key of the keyboard KB is supplied, the control unit CPU proceeds to a decision step S5 in the flow chart of FIG. 3 to determine whether the key input signal KBS is one generated by the depression of a character key or not. Because the signal was generated by the depression of the space key in this case, it is determined that a character key was depressed, and the process proceeds to a step S6.

In the step S6, the space code is stored at a position in the text memory specified by the data at the cursor pointer CP, the cursor pointer CP is incremented by one, and the process returns to the step S3 where the content of the display memory is displayed and the next key input is monitored.

In the keying operation procedure 2, even if the space key is depressed twice in succession, the same control is carried out, and "4" is stored in the cursor pointer CP and the content shown in the display column of the procedure 2 is displayed.

In a procedure 3, when the character input mode designation key "KATA" is depressed, the steps S5, S7, S9 and S10 in the flow chart of FIG. 3 are executed. In the step S10, the KATAKANA character input mode code is stored in the mode memory MODE. In a step S11, whether the content of the cursor pointer is "1" or not is checked. Since it is not "1" in this case, the process returns to the step S3.

In a procedure 4, when the tab-set key "TABSET" is depressed, the steps S5, S7, S9, S13 and S14 in the flow chart of FIG. 3 are carried out. In the step S14, the content of TAB1 is "0". Therefore, the process proceeds to a step S15 where the data "4" in the cursor pointer CP is stored in TAB1, and the data "KATA" in the mode memory MODE is stored in the mode memory area MODE1 of TAB1. Then, the process returns to the step S3.

In a procedure 5, when the return key "RETURN" is depressed, the steps S5, S7 and S8 of the flow chart of FIG. 3 are carried out. In the step S8, the data in the memory DiSP is printed and line spaced, and then the memory DiSP is cleared and data "1" is stored in the cursor pointer CP. Then, the process returns to the step S2, where the character input mode code "ALPHA" stored in the memory HOMO is read and it is stored in the memory MODE. Then, the process proceeds to the steps S3 and S4 to display the content of the memory DiSP and monitor the depression of the key.

In a procedure 6 of FIG. 2, when a key "$V_f$" is depressed, the process proceeds to the step S6 from the step S5 in the flow chart of FIG. 3. Since the current character input mode is "ALPHA", "V" is stored at a position in DiSP designated by the data "1" of the cursor pointer CP, and the cursor pointer CP is incremented by one. Then, the process returns to the step S3.

In a procedure 7, when a key "$8_z$" is depressed, "8" is stored in the memory DiSP in the same manner as the procedure 6.

In a procedure 8, when the tabulation key "TAB" is depressed, the steps S5, S7, S9, S13 and S20 of the flow chart of FIG. 3 are executed. Since the data "4" in TAB1 is larger than the data "3" in the cursor pointer CP, the process proceeds to a step S21. In the step S21, the data in TAB1 is stored into the cursor pointer CP and the data "KATAKANA input mode" in the mode memory area MODE1 is stored in the memory MODE. Then, the process returns to the step S3.

In a procedure 9, when a key "G" is depressed, the steps S5 and S6 is the flow chart of FIG. 3 are executed. Since the current character input mode is "KATAKANA input mode", "ｷ" is stored into the memory DiSP.

In a procedure 10, when keys "ｶ", "K," and "ｲ" are sequentially depressed, the characters "ｷｲ" are sequentially stored into the memory DiSP in the same manner as in the procedure 9.

In a procedure 11, when the return key "RETURN" a depressed, the data "V8" in the memory DiSP is printed out on a print sheet. Then, the carriage return is executed, the content of the memory DiSP is cleared, "1" is stored into the cursor pointer CP and the process returns to the step S3.

By manipulating the tabulation key, any mode can be selected in the steps S9, S10, S11 and S3 even if the mode is switched simultaneously with the execution of tabulation.

What I claimed is:

1. An electronic apparatus for inputting characters comprising:

input means for inputting character data of different categories;

tabulation setting means for setting tabulation positions;

mode selection means for selecting one of a plurality of character input modes of said input means to designate a category of character data to be input when a tabulation position is set by said tabulation setting means;

memory means for storing tabulation positions which have been set by said tabulation setting means;

input mode memory means for storing the character input modes selected by said mode selection means corresponding to the tabulation positions stored in said memory means; and output control means for outputting character data in the category corresponding to the character input mode stored in said input mode memory means in response to the setting of each of the tabulation positions by said tabulation setting means.

2. An apparatus according to claim 1 further comprising:

display means for displaying a character pattern corresponding to the character data output from said output control means.

3. An apparatus according to claim 2 wherein said display means displays a cursor pattern, wherein said apparatus further comprises:

tabulation execution means for moving the cursor pattern on said display means according to the tabulation positions stored in said memory means; and mode setting means for setting character input modes in response to the operation of said tabulation execution means.

4. An apparatus according to claim 3 further comprising:

pattern memory means for storing the character pattern.

5. An apparatus according to claim 1 further comprising:

pattern memory means for storing a character pattern.

6. An apparatus according to claim 1 further comprising:

printing means for printing a character pattern corresponding to character data output from said output control means.

7. An electronic apparatus for inputting characters comprising:

input means for inputting character data of different categories and cursor position data;

display means for displaying a character pattern corresponding to the character data input by said input means;

cursor control means for controlling said display means to display a cursor pattern and for moving the cursor pattern on said display means in response to the inputting of the cursor position data by said input means;

mode setting means for setting the character input mode of said input means to designate a category of input character data to be input in accordance with the position of the cursor pattern on said display means;

memory means for storing the character input mode set by said mode setting means corresponding to the cursor position data; and display control means for controlling said display means to display a character pattern corresponding to the input character data in the category corresponding to the character input mode stored in said memory means in accordance with the position of the cursor pattern.

8. An apparatus according to claim 7 further comprising:

pattern memory means for storing the character pattern.

9. An apparatus according to claim 7 further comprising:

memory means for storing the character data input by said input means; and printing means for printing the character pattern corresponding to the character data stored in said memory means.

* * * * *

UNITED STATES PATENT AND TRADEMARK OFFICE

CERTIFICATE OF CORRECTION

PATENT NO. : 4,865,474

DATED : September 12, 1989

INVENTOR(S) : Shigeru Matsuyama

It is certified that error appears in the above-identified patent and that said Letters Patent is hereby corrected as shown below:

On the title page and col. 1, lines 1 - 3

"IMPUTTING" should read --INPUTTING--.

COLUMN 2:

Line 1, "characters of" should read --characters.--.

Line 2, "Japanese character." should be deleted.

Line 3, "in the form of" should read --which can be a--.

COLUMN 3:

Line 50, "key "$8_z$"" should read --key "$8_1$"--.

Line 63, "is" should read --in--.

Signed and Sealed this

Nineteenth Day of January, 1993

*Attest:*

DOUGLAS B. COMER

*Attesting Officer*

*Acting Commissioner of Patents and Trademarks*